United States Patent [19]

Maldonado

[11] 3,947,928

[45] Apr. 6, 1976

[54] SNAP-ON SHOE LACE

[75] Inventor: Blanca Maldonado, Long Island City, N.Y.

[73] Assignee: Lawrence Peska Associates, Inc., New York, N.Y. ; a part interest

[22] Filed: Feb. 6, 1975

[21] Appl. No.: 547,720

[52] U.S. Cl. ..... 24/143 R

[51] Int. Cl.[2] ..... A43C 9/00

[58] Field of Search ..... 24/49 CF, 17 A, 153 FB, 24/206 A, 143, 203

[56] References Cited

UNITED STATES PATENTS

| | | | |
|---|---|---|---|
| 654,668 | 7/1900 | Pergande | 24/17 A |
| 1,140,442 | 5/1915 | Cardy | 24/143 B UX |
| 1,345,750 | 7/1920 | Beaumont | 24/203 |
| 2,499,898 | 3/1950 | Anderson | 24/206 A |
| 2,627,093 | 2/1953 | Boyles | 24/203 X |
| 2,646,630 | 7/1953 | Miller | 24/143 R X |
| 3,430,297 | 3/1969 | Weier | 24/17 A |
| 3,534,447 | 10/1970 | Muirhead | 24/153 FB |
| 3,701,572 | 10/1972 | Velasquez | 24/143 A X |

*Primary Examiner*—Donald A. Griffin
*Attorney, Agent, or Firm*—Richard E. Nanfeldt

[57] ABSTRACT

A snap on shoe lace eliminates the conventional tying of the ends of the shoe lace. The snap on shoe lace consists of an elongated plastic or cloth strip member. A plurality of snap members are embedded in the back face of a first end of the elongated member and a plurality of snap receiving members are embedded in the front face of a second end of the elongated member. When the shoe lace is laced through the lacing holes of the flaps of a shoe, the first and second ends of the shoe lace extend outward from the top lacing hole of each flap. The first and second ends of the shoe lace are secured to each other by the engagement of the snap members and snap receiving members. A design pattern can be printed on the front face of the elongated strip.

3 Claims, 8 Drawing Figures

SNAP-ON SHOE LACE

SUMMARY OF THE INVENTION

My invention relates to a unique and novel shoe lace for a shoe having lacing holes longitudinally aligned on two flap members of the shoe.

A number of U.S. Pat. Nos. 1,505,430; 2,506,332; 2,575,226; 3,137,952; and 3,197,833 have employed various means for securing together the two flaps of a shoe, but these aforementioned patents are non-applicable to my present invention.

An object of my present inventon is to provide a means for securing together the free ends of a shoe lace extending outward from the top lacing holes of two flaps of a shoe, wherein the ends of the shoe lace do not have to be tied together.

A further object of my present invention is to provide a design pattern for the front face of the shoe lace.

A still further object of my present invention is to provide an article having a design thereon, wherein the article detachably mounts onto a front face of the shoe lace.

Briefly, my present invention comprises an elongated plastic or cloth strip member. A plurality of snap members are embedded in the back face of a first end of the elongated member and a plurality of snap receiving members are embedded in the front face of a second end of the elongated member. When the shoe lace is laced through the lacing holes of the flaps of a shoe, the first and second ends of the shoe lace extend outward from the top lacing hole of each flap. The first and second ends of the shoe lace are secured to each other by the engagement of the snap members and snap receiving members. A design pattern can be printed on the front face of the elongated strip.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 2:
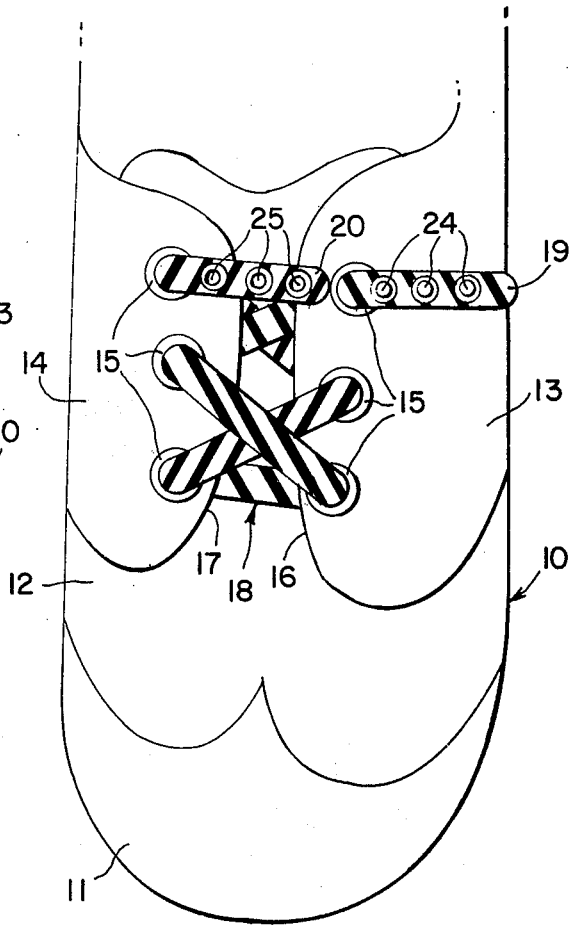
FIG. 2 illustrates a top view of the snap-on shoe lace laced through the lacing holes of the shoe, wherein the ends are not secured together.

Turning now descriptively to the drawings, in which similar reference characters denote similar elements throughout the several views, FIG. 2 shows a conventional shoe 10 having a toe portion 11 and an upper portion 12, wherein the upper portion 12 has two conventional adjacent flaps 13, 14. A plurality of lacing eyelets 15 are longitudinally arranged along each inner edge 16, 17 of each flap 13, 14. A snap-on shoe lace 18 is laced through the eyelets 15 in a conventional manner, wherein the ends 19, 20 of the shoe lace 18 extend outward from the top eyelets 15 of each flap 13, 14.

Figure 3:
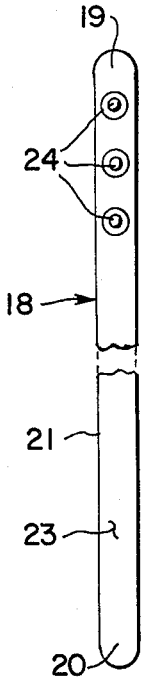
FIG. 3 illustrates a rear view of the snap-on shoe lace.
Figure 4:
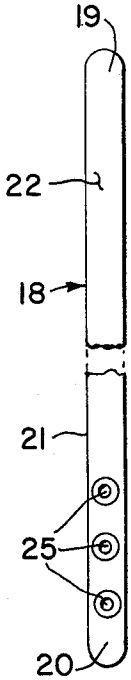
FIG. 4 illustrates a front view of the snap-on shoe lace.

The snap of shoe lace 18 as shown in FIGS. 3, 4 consist of an elongated flexible cloth on plastic member 21. The front 22 and back 23 faces of the elongated member 21 are plain. A plurality of snap members 24 are longitudinally arranged along the back face 23 at a first end 19 of the elongated member 21. A plurality of snap receiving members 25 are longitudinally arranged along a front face 22 at a second end 20 of the elongated member 21.

Figure 1:
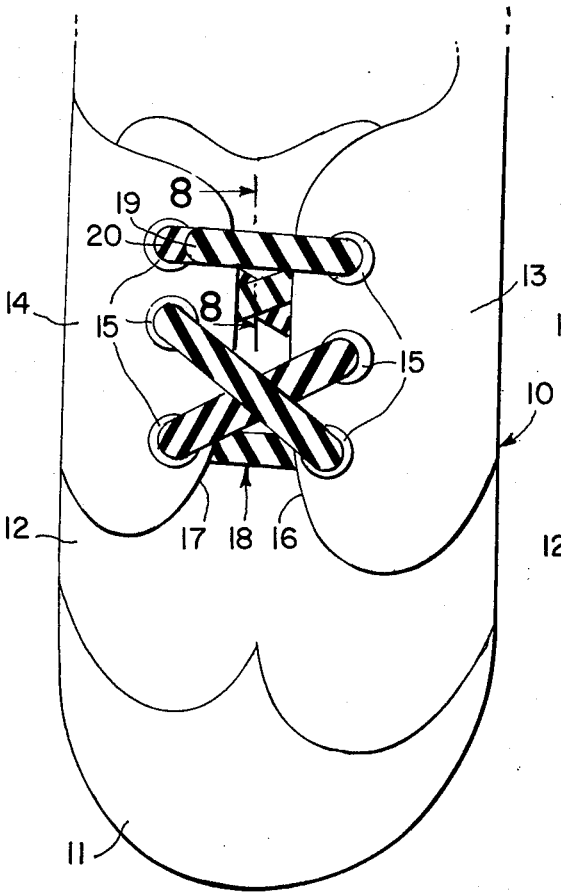
FIG. 1 illustrates a top view of a snap-on shoe lace laced through the lacing holes of a shoe, wherein the ends are secured together.
Figure 8:
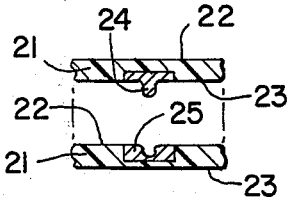
FIG. 8 illustrates a side cross sectional view of the mechanism for securing the ends of the snap-on shoe lace together.

FIGS. 1, 8 show the first end 19 of the shoe lace 18 positioned on top of the second end 20 of the shoe lace 18, wherein the snap members 24 insert into the snap receiving member 25 securing the ends 19, 20 of the shoe lace 18 together.

Figure 5:
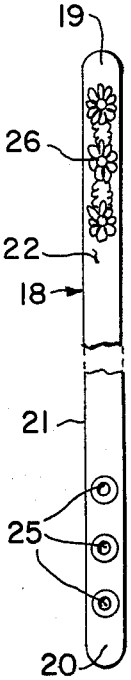
FIG. 5 illustrates a front view of the snap-on shoe lace having a design printed on the front face of the snap-on shoe lace.

FIG. 5 shows a first modification of the shoe lace 18, wherein a design pattern 26 is printed on the front face 22 at the first end of the elongated member 21.

Figure 6:
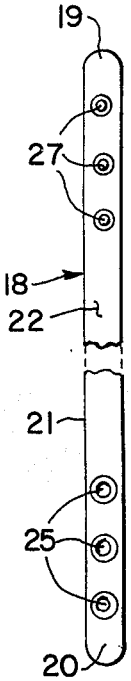
FIG. 6 illustrates a front view of the snap-on shoe lace having snap receiving member in a front face of the snap-on shoe lace.

FIG. 6 shows a second modification of the shoe lace 18, wherein a plurality of second snap receiving members 27 are longitudinally arranged along the front face 22 at a first end 19 of the elongated member 21.

Figure 7:
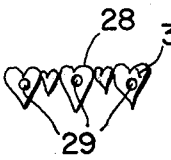
FIG. 7 illustrates a back view of an article formed as a decorative design, wherein the article detachable mounts onto the snap-on shoe lace.

FIG. 7 shows a decorative shaped article 28 having a plurality of second snap members 29 longitudinally arranged along a rear face 30 of the article 28, wherein article 28 detachably mounts onto the front face 22 of the elongated member 21, wherein the second snap members 29 engages the second snap receiving members 27.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A snap on shoe lace adapted to be received through eyelet positioned in flaps of a shoe, which comprises:

a. an elongated flexible member having a pair of ends, a front, and a back face;

b. a plurality of snap members longitudinally arranged on said back face at one said end of said elongated member;

c. a plurality of snap receiving members contained in said elongated member along said front face at said other end of said elongated member, said snap members engaging into said snap receiving members;

d. a pluality of second snap receiving members contained in said front face at one said end of said elongated member;

e. a decorative shaped article; and f. a plurality of second snap members affixed on a rear face of said decorative shaped article, said second snap members engaging into said second snap receiving members.

2. A combination as recited in claim 1, wherein said elongated member is a cloth substance.

3. A combination as recited in claim 1, wherein said elongated member is a plastic substance.

* * * * *